United States Patent [19]

Bryant

[11] 4,059,235

[45] Nov. 22, 1977

[54] SHREDDING DEVICE

[75] Inventor: James G. Bryant, Greencastle, Ind.

[73] Assignee: Bryant-Poff, Inc., Coatesville, Ind.

[21] Appl. No.: 690,946

[22] Filed: May 28, 1976

[51] Int. Cl.[2] ..... B02C 18/18; B02C 18/22

[52] U.S. Cl. ..... 241/223; 241/236

[58] Field of Search ..... 241/223, 227, 236, 280, 241/281, DIG. 31

[56] References Cited

U.S. PATENT DOCUMENTS

| | | | |
|---|---|---|---|
| 2,150,984 | 3/1939 | Near et al. | 241/223 X |
| 2,894,697 | 7/1959 | Panning et al. | 241/236 X |
| 3,170,642 | 2/1965 | Haidler | 241/223 X |
| 3,529,782 | 9/1970 | Liebman | 241/236 X |

*Primary Examiner*—Roy Lake
*Assistant Examiner*—Howard N. Goldberg
*Attorney, Agent, or Firm*—Barnes, Kisselle, Raisch & Choate

[57] ABSTRACT

A shredding device for paperboard cartons having two vertically spaced rotors provided with teeth around their periphery. The teeth on the two rotors overlap radially. A conveyor is arranged to feed cartons to the shredding rotors and to crush the cartons, if they happen to be oversize, to a predetermined maximum vertical dimension. The rotors have a diameter approximately twice the maximum vertical dimension of the cartons fed to the shredding rotors.

3 Claims, 6 Drawing Figures

SHREDDING DEVICE

This invention relates to a shredder and, more particularly, to a shredding device for paperboard cartons and the like.

In many business enterprises there is a daily accumulation of paperboard cartons in very large quantities. Frequently such cartons are merely crushed and bailed. However, it has been recognized that, if such cartons are shredded before bailing, the bails may be compacted to a substantially higher density than cartons that are merely crushed. The more densely compacted bails occupy substantially less space and, thus, reduce the cost of storing and disposing of such cartons.

The present invention has for its primary object the provision of a shredding device for paperboard cartons which operates very efficiently with only two shredding rotors of moderate size as compared with three or more rotors of prior shredding machines.

Another object of the invention is to provide a shredding device which is of rigid, but, nevertheless, very economical construction.

More specifically, the shredding device of the present invention is designed to handle cartons which have or are reduced to a predetermined vertical dimension, preferably about 12 inches. Larger cartons can be crushed down to a lesser size very easily; for example, by a pair of converging conveyor belts. In the present invention the discharge end of such a conveyor is positioned adjacent the inlet of a shredding chamber within which are journalled two vertically spaced rotors. Each rotor comprises a series of discs spaced along rotor shafts which have radially projecting teeth around their peripheries. The successive discs on one rotor shaft are staggered axially between the successive discs on the other rotor shaft and the teeth on the two rotors overlap radially.

Other objects, features and advantages of the present invention will become apparent from the following description and accompanying drawings, in which.

Figure 1:
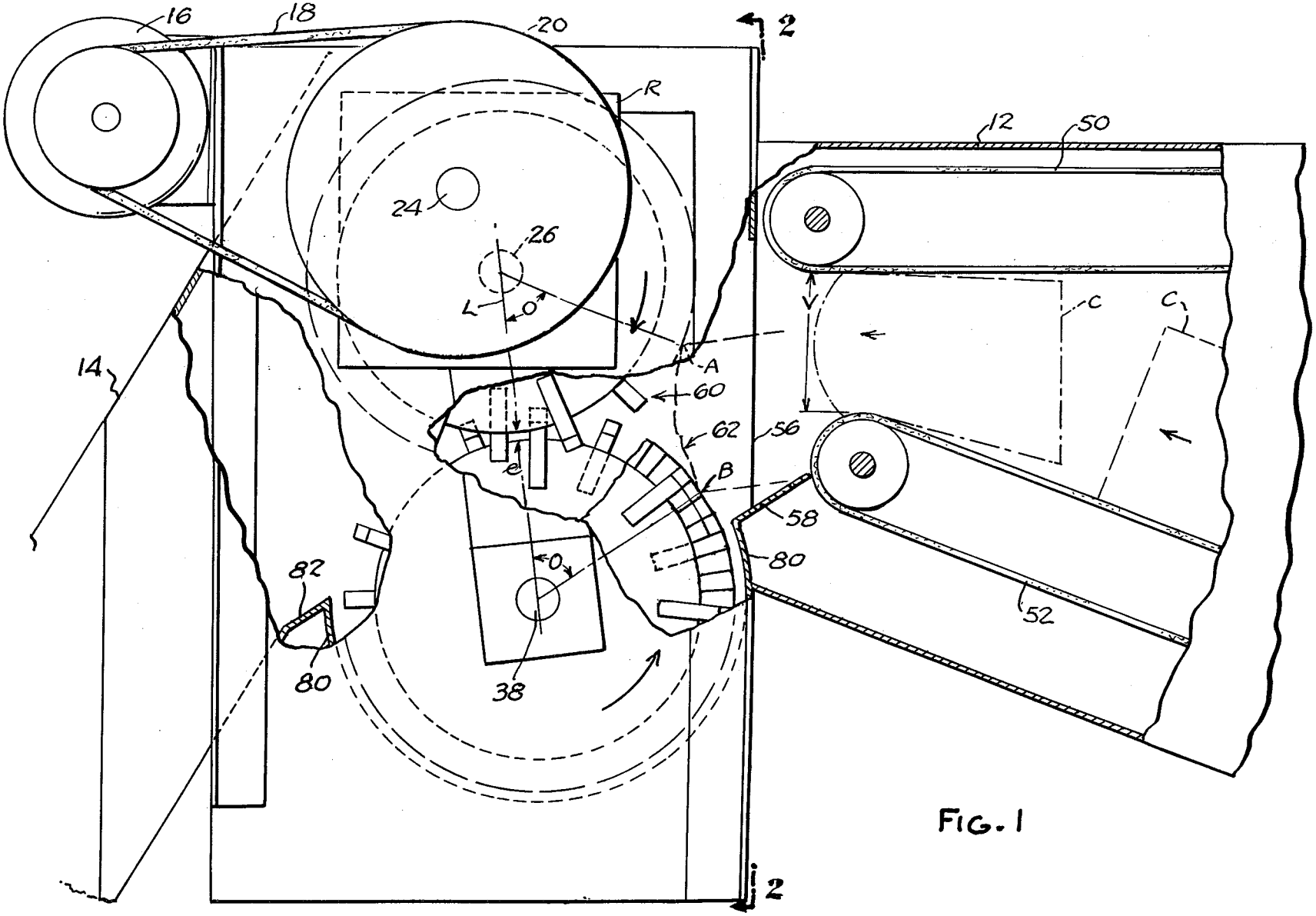
FIG. 1 is a fragmentary side elevational view, partly in section, of the shredding device of the present invention.
Figure 2:
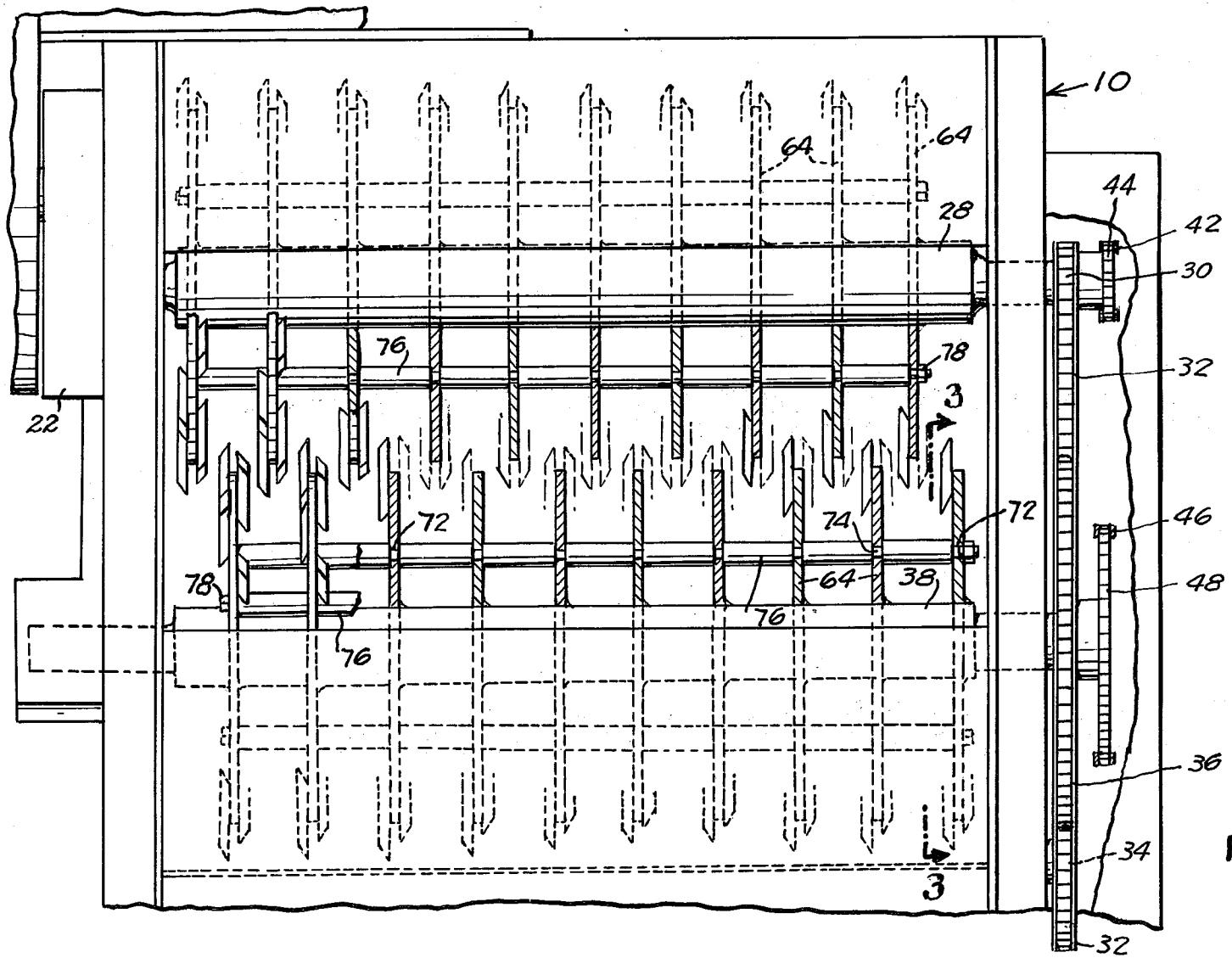
FIG. 2 is a sectional view generally along the line 2—2 in FIG. 1.
Figure 5:
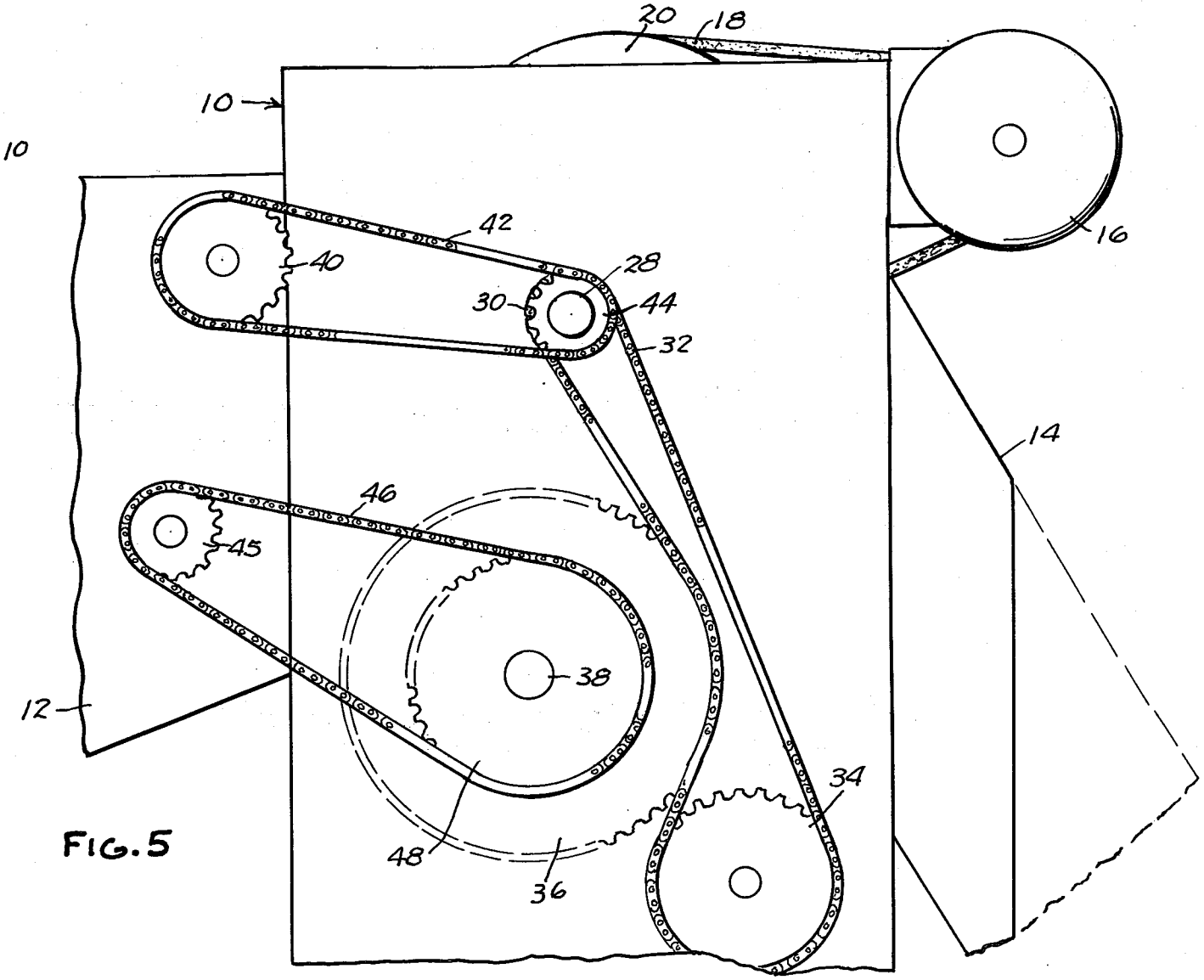
FIG. 5 is a generally diagrammatic view illustrating the drive arrangement of the shredding device.
Figure 6:
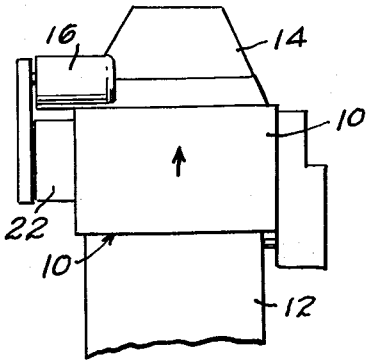
FIG. 6 is a plan view on a small scale of the shredding device.

Referring first to FIGS. 1, 5 and 6, a shredding device includes a shredding chamber 10 having an inlet chute 12 at one side thereof and a discharge chute 14 at the opposite side thereof. At one end of the shredding chamber there is arranged a motor 16 which has a belt drive 18 with an input gear 20 of a speed reducer 22. In FIG. 1 the input shaft of speed reducer 22 is designated 24 and the output shaft thereof is designated 26. Shaft 26 is connected directly with one end of an upper rotor shaft 28 (FIG.2). The opposite end of shaft 28 has a sprocket 30 thereon which drives a chain 32 trained around an idler sprocket 34 and a large sprocket 36 fixed on the end of a lower rotor shaft 38. An upper conveyor drive sprocket 40 has a chain drive 42 with a second sprocket 44 (FIG. 2) on shaft 28. Likewise, a lower conveyor sprocket 45 has a chain drive 46 with a second sprocket 48 keyed to the end of the lower rotor shaft 38. The drive arrangement thus far described is designed to rotate the two conveyor sprockets at about the same speed. However, the upper rotor shaft 28 is rotated at about four times the speed of the lower rotor shaft 38. More specifically, in the arrangement shown the upper rotor shaft 28 is rotated at about 51 r.p.m. and the lower rotor shaft 38 is rotated at about 12 r.p.m. Although a speed ratio of the top to bottom rotors of about four to one is preferred, this ratio may be as low as three to one or as high as five to one.

Referring now to FIG. 1, within the inlet chute 12 there is arranged an upper belt conveyor 50 and a lower belt conveyor 52. Conveyor 50 is driven by sprocket 40 and conveyor 52 is driven by sprocket 45. Conveyor belt 50 extends generally horizontally while conveyor belt 52 is inclined upwardly. At the discharge end thereof two conveyor belts are spaced vertically apart a distance V. In the preferred design of the shredder device the distance V is between eleven and twelve inches. Accordingly, when a paperboard carton C is directed upwardly between the conveyor belts 50,52, its vertical dimension is reduced to the dimension V when it reaches the discharge end of the conveyor. As explained hereinafter, this dimension is important in relation to the dimension of the shredding rotors in shredding chamber 10.

Figure 3:
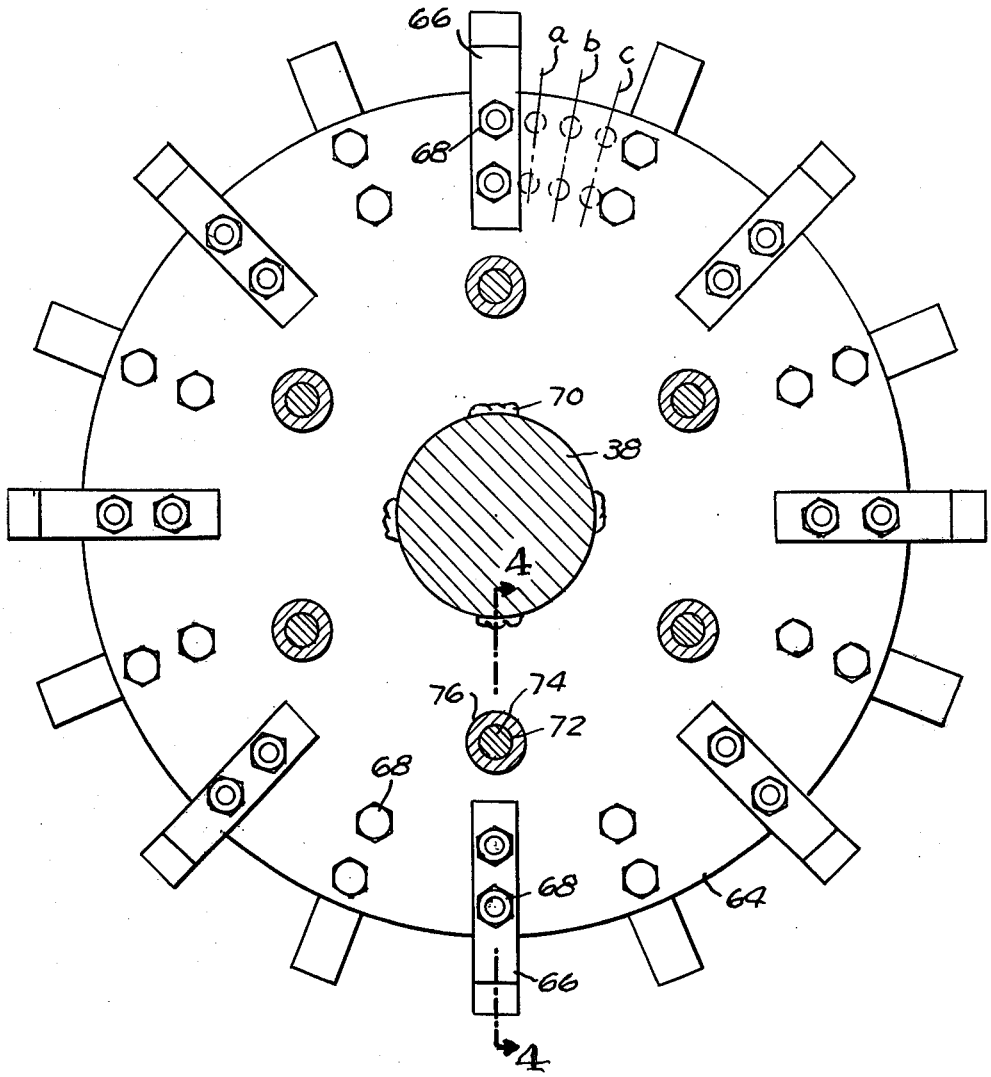
FIG. 3 is a sectional view along the line 3—3 in FIG. 2.
Figure 4:
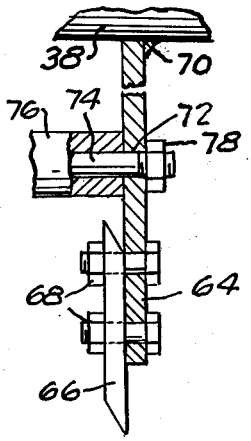
FIG. 4 is a fragmentary sectional view along the line 4—4 in FIG. 3.

At the discharge end of conveyors 50,52 the side wall of chamber 10 is formed with an inlet opening 56. The lower edge of this inlet opening is defined by a guide plate 58 which extends downwardly from the upper end of lower conveyor 52. Within chamber 10 the two shredding rotors, generally designated 60,62, are journalled. The two shredding rotors are of the same construction and comprise a series of discs 64 which are mounted on and spaced along their respective shafts 28,38. Around the outer periphery of each disc 64 there is mounted a plurality of shredding teeth 66. The circumferentially successive teeth 66 on each disc 64 are secured to the opposite faces of the discs. While the spacing of the teeth is the same on all of the discs, the discs themselves are divided into four groups of 3, 2, 2, and 3 discs. As shown in FIG. 3, the topmost teeth on the first three discs are on the vertical centerlines of the discs. On the next two discs the adjacent tooth would be secured to the disc at the line designated *c*, on the two next successive discs at the line designated *b*, on the following two discs at the line designated *c*, and on the last three discs at the line designated *a*. The tooth members 66 are secured to the respective plates by a pair of nut and bolt assemblies 68.

Each disc 64 is secured to its respective shaft by means of four short arc welds 70, as shown in FIG. 3. For example, assuming that the rotor shafts 28,38 have a diameter of about 5½ inches, the four arc welds 70 are spaced apart 90° and have an arcuate extent of about only 1 inch. However, each disc 64 is also provided with a plurality of additional holes 72 through which bolts 74 extend from one end of the rotor to the other. Between successive discs spacers 76 are arranged on the bolts and the whole assembly is clamped rigidly together by nuts 78 on the ends of the bolts 74.

I have found that the disc clamping arrangement provided by spacers 76, bolts 74 and nuts 78 results not only in a very rigid rotor, but also one which can be assembled economically. This clamping design enables the use of relatively small welds on only one side of each disc which avoids the troublesome problem of warping of the shaft which would normally result with heavy or continuous welding. Accordingly, the rotor plates can be arranged accurately perpendicular to the axis of the shaft. In addition, the use of the clamping bolts and spacers imparts such rigidity to the rotor that it acts as a single unit in the event of an excessive load on one or more of the teeth.

As indicated previously and as shown in the drawings, the present shredding device utilizes only two shredding rotors and these two rotors have a diameter approximately twice the vertical dimension V. As a crushed carton C is discharged from between conveyors 50, 52 it moves forwardly and slightly downwardly through inlet 56 into engagement with the two rotors. The lower rotor 62 is rotating in a counterclockwise direction as viewed in FIG. 1 while the upper rotor 60 is rotating at a much faster speed in a clockwise direction. As the vertically crushed carton advances toward the rotors its upper and lower edges at the leading end thereof are engaged by the teeth on the two rotors at the contact points A and B. If the radii at these points of contact define too large an included angle with the line L connecting the center lines of the two rotors, the carton will not be drawn readily into the rotors and shredded by the teeth thereof. Successive cartons will tend to jam at the inlet 56. I have determined that when these angles (which are designated *o*) lie in the range of about 60 to 75° the cartons will be immediately engaged by the rotor teeth and drawn inwardly therebetween. It will be apparent that the angle *o* depends upon the dimension V in relation to the diameter of the two rotors. If the diameter of the two rotors is approximately twice the dimension V the angles *o* are about 65°. For example, if the dimension V is between eleven and twelve inches and the rotors have a diameter of about 26½ inches and their axes are spaced apart about 23 inches, the teeth of the rotors overlap radially about 2½ inches and the angles *o* are about 64° to 25°. Two rotors of this size are not unwieldly and do not require an excessively large motor to operate them. For efficient operation it is also important that the two sets of discs 64 be spaced apart slightly as at *e* so that the paperboard will pass tangentially between the discs as it is being shredded. The dimension *e* is preferably on the order of ½ inch so that it can accommodate several layers of paperboard. Thus, when the parameters are maintained within the ranges specified, the shredding device operates very efficiently, is not excessive in size and the power requirements to operate it are not unduly large.

It will be appreciated that some of the cartons directed to the shredder will have a vertical dimension less than the dimension V. Such cartons will simply fall off the upper end of conveyor 52 and into the shredding chamber. I have found that the most efficient handling of all cartons is achieved when the axes of the two rotors are arranged so that the line L is inclined away from inlet 56 at a slight angle on the order of about 5° to 10° to the vertical in an upward direction.

After the cartons are shredded the shredded pieces are propelled outwardly of chamber 10 through discharge chute 14. The lower half of rotor 62 is surrounded by a shield 80 which extends in an arc from a guide plate 58 to baffle 82 at the outlet of the chamber. The provision of shield 80 prevents the accumulation of shredded paperboard at the lower end of chamber 10.

I claim:

1. A shredding device comprising means forming a shredding chamber having an inlet lying in a generally vertical plane and an outlet, two rotors journalled in said chamber directly adjacent said inlet on vertically spaced, horizontally extending axes so that a carton entering said chamber through said inlet is immediately engaged by said two rotors, said rotors each comprising a central shaft having a plurality of circular discs fixed thereon at regularly spaced intervals along the axis of the shaft, the discs on one rotor being staggered axially between the discs on the other rotor, each of said discs having a plurality of regularly spaced tooth members projecting radially from the periphery thereof, the tooth members on one rotor projecting radially into the space between the tooth members on the other rotor at the circumferentially adjacent portions of the two rotors so that the teeth radially overlap, means for rotating the rotors at different speeds and in opposite directions so that at the side of the rotors adjacent said inlet the teeth on the two rotors rotate toward each other, each disc being provided with a central opening through which the shaft extends, each disc being secured to its respective shaft by a series of short circumferentially extending arc welds, the successive discs also having a plurality of axially aligned openings therein spaced radially outwardly from said shaft, a rod extending through each row of aligned openings, spacers on said rods between the adjacent discs and means on said rod axially clamping the spacers and discs together.

2. The combination called for in claim 1 wherein said rods comprise threaded bolts and said clamping means comprise nuts threaded on the ends of said bolts.

3. The combination called for in claim 2 wherein the circumferential extent of said welds is substantially less than the arcuate space between successive welds.

* * * * *